US006904714B1

(12) United States Patent
Chen

(10) Patent No.: US 6,904,714 B1
(45) Date of Patent: Jun. 14, 2005

(54) DECORATIVE FLOWER STAND

(76) Inventor: Feng-Kuei Chen, P.O. Box 90, Tainan City (TW)

( * ) Notice: Subject to any disclaimer, the term of this patent is extended or adjusted under 35 U.S.C. 154(b) by 0 days.

(21) Appl. No.: 10/885,116

(22) Filed: Jul. 7, 2004

(51) Int. Cl.[7] ..... A01G 5/04
(52) U.S. Cl. ..... 47/41.01
(58) Field of Search ..... 47/65.5, 67, 41.01, 47/41.1, 39

(56) References Cited

U.S. PATENT DOCUMENTS 1,765,140 A * 6/1930 Fitl ..... 47/41.01
1,958,790 A * 5/1934 Jippson ..... 47/41.1
2,010,246 A * 8/1935 Slawson ..... 47/41.01
5,456,046 A * 10/1995 Vitalune et al. ..... 47/41.01

FOREIGN PATENT DOCUMENTS

JP 2002291595 A * 10/2002 ..... A47G 7/02
JP 2003129696 A * 5/2003 ..... E04H 13/00
JP 2004154397 A * 6/2004 ..... A47G 7/06

* cited by examiner

*Primary Examiner*—Son T. Nguyen

(57) ABSTRACT

A decorative flower stand includes a decorative plate and one or more vases. The decorative plate is bored with at least one insert groove and each vase has its outer wall provided with an engage block to be fitted with the insert groove to fix the vase on the decorative plate. The decorative plate has its rear side provided with fastening members, such as screws, magnets, sucking disks, magic blankets or two-sided adhesive tapes so that the decorative plate can be assembled on the stationary surface of a certain location where people wish to place fresh flowers, such as the faceplate of a cinerary cabinet, the surface of a wall, the surface of a refrigerator or the glossy surface of a piece of furniture and glass, and the vase has fresh flower set therein, having an effect of beautifying the interior of a house.

3 Claims, 3 Drawing Sheets

DECORATIVE FLOWER STAND

BACKGROUND OF THE INVENTION

1. Field of the Invention

This invention relates to a decorative flower stand, particularly to one composed of a decorative plate and vases. The decorative plate is bored with insert grooves, and each vase is provided with an engage block on the outer wall to be fitted with the insert groove of the decorative plate so as to fix the vase on the decorative plate. The decorative plate has its rear side provided with fastening members, such as screws, magnets sucking disks, magic blankets or two-sided adhesive tapes, so that the decorative plate can be firmly assembled on the stationary surface of a place where people wish to place fresh flowers, such as the faceplate of a cinerary cabinet, the surface of a wall, the surface of a refrigerator or the glossy surface of a piece of furniture or glass, and the vase has fresh flowers set therein, having an effect of beautifying the interior of a house.

2. Description of the Prior Art

Generally, people like to display vases with fresh flowers on the topside of a table or a cabinet or the like to beautify the interior of a house. However, locations in a house for displaying vases may be limited so it is impossible to display vases at a place one prefers. If vases are to be placed at certain locations on a wall, a flat stand has to be built for this purpose, thus causing much trouble and rendering the vases unstable and easy to be hit and tumble down.

Nowadays, most people have their ancestors' bone ashes held in cinerary cabinets which are orderly placed in a cinerary tower, but the cinerary cabinets in the cinerary tower are arranged side by side without providing any flower stand for people to place fresh flowers and fruit thereon for worshiping their ancestors.

SUMMARY OF THE INVENTION

The objective of the invention is to offer a decorative flower stand provided with a decorative plate able to be firmly assembled on a stationary surface for people to place fresh flowers thereon, unnecessary to build an additional flat stand and able to stabilize vases on the decorative plate, having an effect of beautifying the interior of a house.

The feature of the invention is the decorative plate bored with at least one insert groove and the vase provided with an engage block on the outer wall to be fitted with the insert groove of the decorative plate, with the vase formed with an upper opening.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
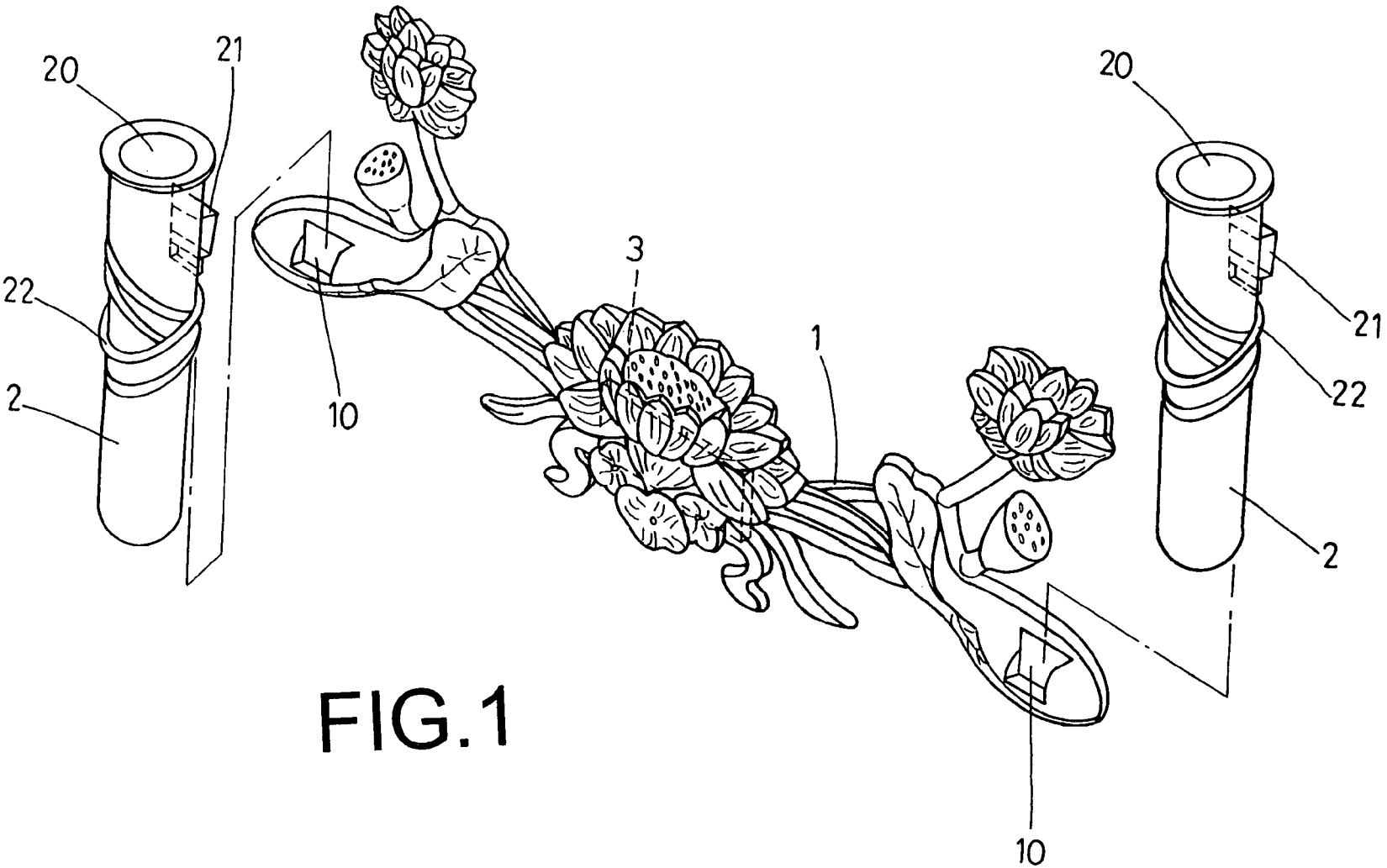
FIG. 1 is an exploded perspective view of a decorative flower stand in the preset invention.

A preferred embodiment of a decorative flower stand in the preset invention, as shown in FIG. 1, includes a decorative plate 1, vases 2 and fastening members 3.

There are two decorative plates 1. Each decorative plate 1 is to be fixed on a stationary surface for people to place fresh flowers thereon, such as the faceplate of a cinerary cabinet, the surface of a wall, the surface of a refrigerator or the surface of a piece of furniture or glass, able to be designed into various decorative shapes. The decorative plate is bored with at least one dovetail-shaped groove 10.

There are two vase 2. Each vase 2 to be fitted with the decorative plate 1 is formed with an upper opening 20, and has an outer wall provided with a dovetail-shaped engage block 21 and an outer circumferential surface provided with different-shaped decorative stripes 22.

A fastening members 3 provided on the rear side of the decorative plate 1 could be screws, magnets, sucking disks, magic blankets or two-sided adhesive tapes. The fastening member 3 serves to combine the two decorative plates 1. Then each vase 2 is combined with a respect one of the two decorative plates 1 by engaging the dovetail-shaped engage block 21 with the dovetail-shaped groove 10.

Figure 2:
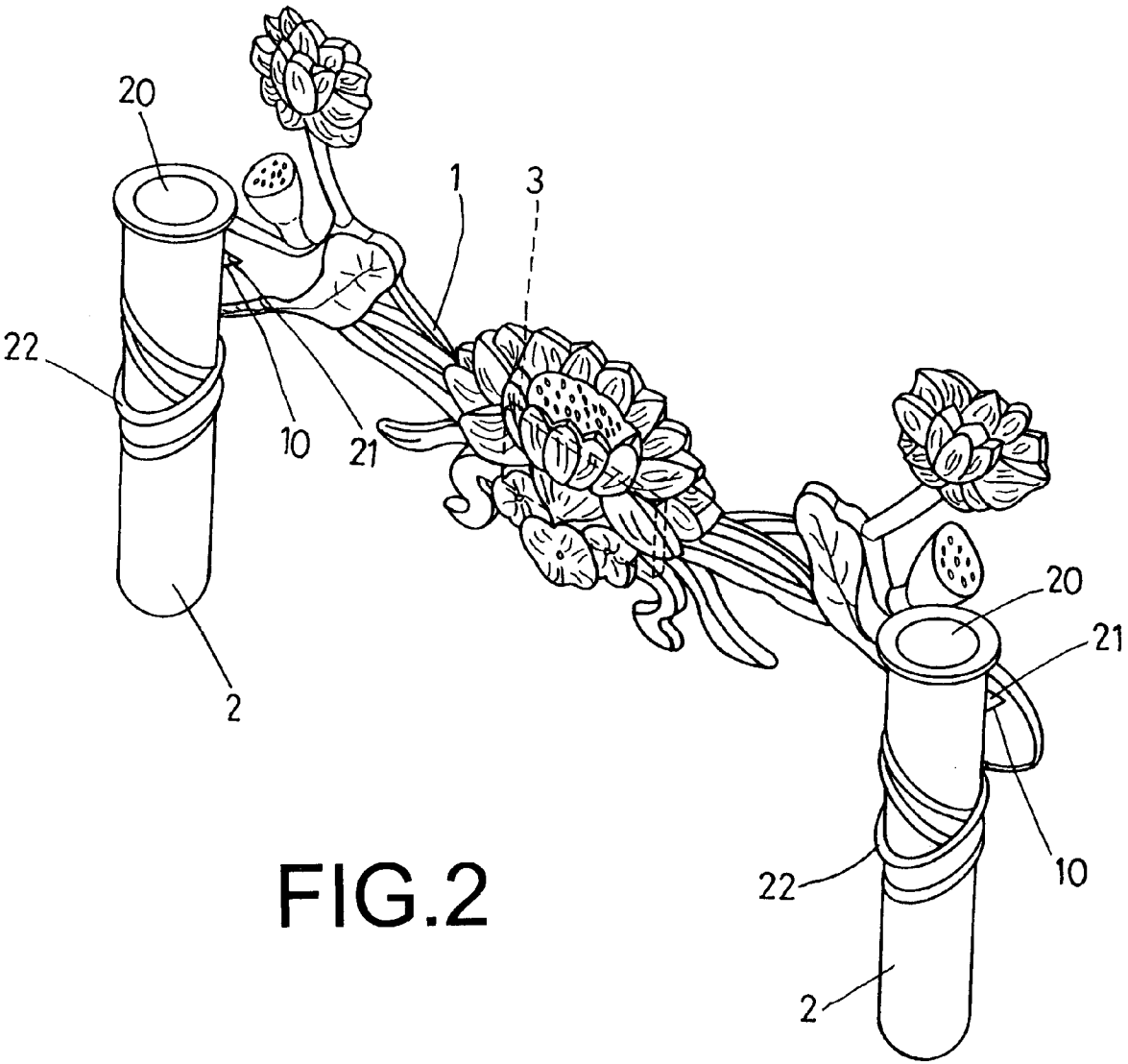
FIG. 2 is a perspective view of the decorative flower stand in the present invention; and, FIG. 3 is a front view of the decorative flower stand assembled on the faceplate of a cinerary cabinet in the present invention.
Figure 3:
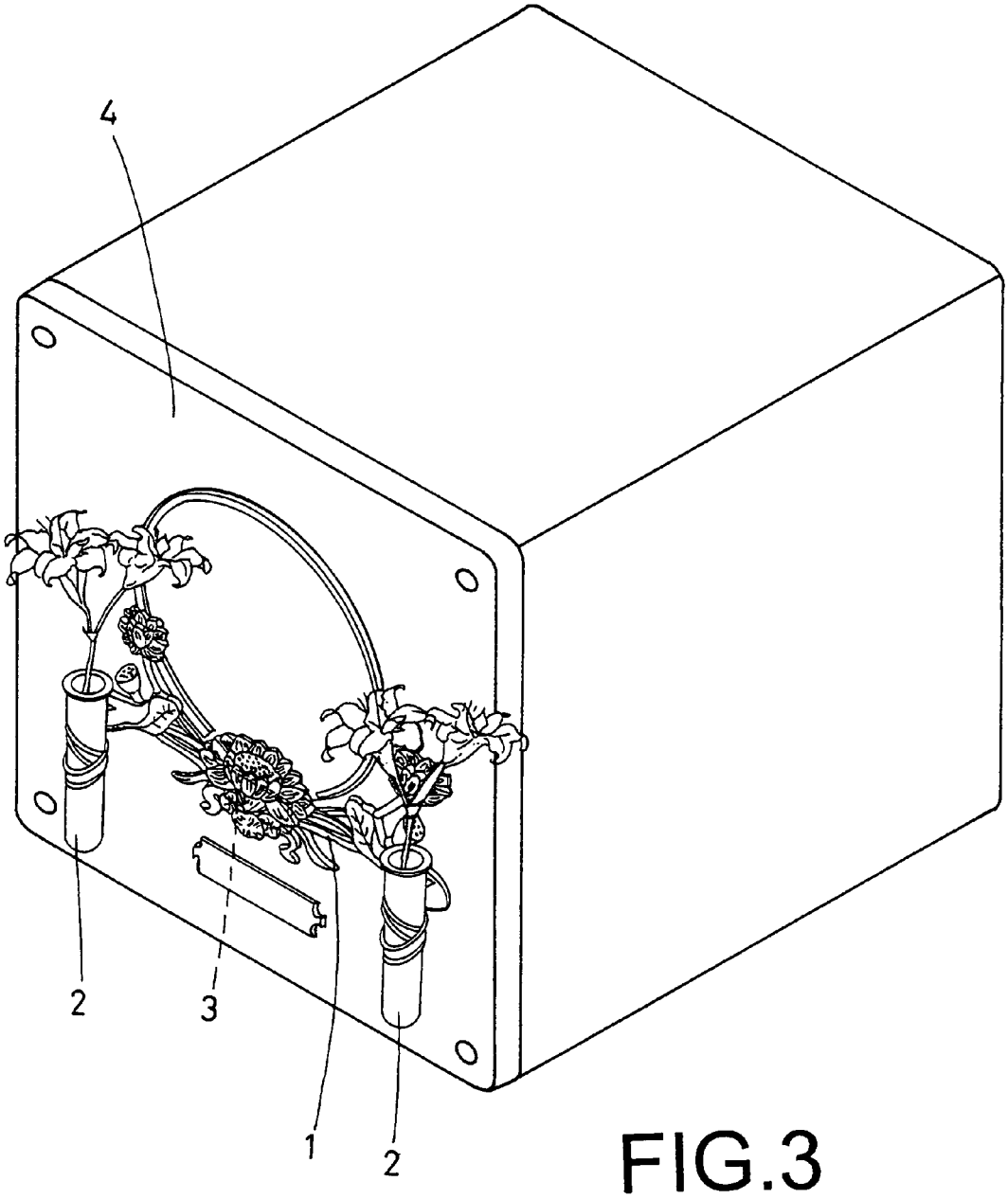

In assembling and using, as shown in FIGS. 2 and 3, the decorative plate 1 is first firmly assembled on a stationary surface 4 of a place where people wish to display fresh flowers, such as the faceplate of a cinerary cabinet, as shown in FIG. 3, the flat surface of a piece of furniture, the glossy surface of glass or the surface of a wall. Next, the vase 2 is filled with a proper amount of water and has its engage block 21 fitted with the insert groove 10 of the decorative plate 1 to fix the vase 2 on the decorative plate 1, and then have fresh flowers set in the vase 2.

The decorative flower stand of this invention can be fixedly assembled at a certain location where people wish to place fresh flowers, not only letting a house filled with the fragrance of the fresh flowers, but also beautifying the interior of the house.

In case the water in the vase 2 is insufficient or needs to be replaced with fresh water, simply remove the vase 2 from the decorative plate 1 and, after having it cleaned and filled with fresh water, it is returned on the decorative plate 1 again, convenient in use. In addition, the decorative plate 1 itself is provided thereon with different-shaped beautiful designs; therefore, the decorative flower stand of this invention has an effect of interior decoration even if there should be no flowers set thereon.

While the preferred embodiment of the invention has been described above, it will be recognized and understood that various modifications may be made therein and the appended claims are intended to cover all such modifications that may fall within the spirit and scope of the invention.

What is claimed is:

1. A decorative flower stand comprising:

two decorative plates, each decorative plate being bored with at least one insert groove;

two vases, each vase having an opening at a topside thereof and an outer wall thereof being provided with a dovetail-shaped engage block; each vase being connected with a respect one of the two decorative plates by engaging the dovetail-shaped engage block with the dovetail-shaped groove; and said vase having its outer circumferential surface provided with different-shaped decorative stripes; and, a fastening member for connecting the two decorative plates;

wherein said decorative plate are firmly assembled on the stationary surface of a location where people wish to place fresh flowers.

2. The decorative flower stand as claimed in claim 1, wherein said fastening members is one of screws, magnets, sucking disks, magic blankets, and two-sided adhesive tapes.

3. The decorative flower stand as claimed in claim 1 wherein said stationary surface is one of a faceplate of a cinerary cabinet, a surface of a wall, a surface of a refrigerator and a glossy surface of a piece of furniture and glass.

* * * * *